US006563467B1

(12) United States Patent
Buris et al.

(10) Patent No.: US 6,563,467 B1
(45) Date of Patent: May 13, 2003

(54) EFFICIENT ANTENNA PATTERN SHAPING STRUCTURE AND ASSOCIATED RADIO CIRCUITRY AND ANTENNA

(75) Inventors: Nicholas Evangelos Buris, Deer Park, IL (US); John Allan Svigelj, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/035,087

(22) Filed: Dec. 28, 2001

(51) Int. Cl.[7] ..... H01Q 1/24

(52) U.S. Cl. ..... 343/702; 343/700 MS; 343/815; 343/817; 343/818

(58) Field of Search ..... 343/700 MS, 702, 343/815, 817, 818, 819, 848

(56) References Cited

U.S. PATENT DOCUMENTS

| | | | | | |
|---|---|---|---|---|---|
| 6,046,703 | A | * | 4/2000 | Wang et al. | 343/795 |
| 6,181,283 | B1 | * | 1/2001 | Johnson et al. | 343/702 |
| 6,246,374 | B1 | * | 6/2001 | Perrotta et al. | 343/702 |
| 6,285,327 | B1 | * | 9/2001 | See | 343/702 |
| 6,456,249 | B1 | * | 9/2002 | Johnson et al. | 343/702 |

OTHER PUBLICATIONS

Constantine A. Balanis—Arizona State University; "*Antenna Theory—Analysis and Design*"; Harper & Row, Publishers, New York; 1982 pp. 385–411.

Roger Yiew–Siow Tay, Quirino Balzano, Niels Kuster; "*Dipole Configurations with Strongly Improved Radiation Efficiency for Hand–Held Transceivers*"; IEEE Transactions on Antennas and Propagation, vol. 46, No. 6, Jun. 1998; pp. 798–806.

* cited by examiner

*Primary Examiner*—Don Wong
*Assistant Examiner*—Shih-Chao Chen
(74) *Attorney, Agent, or Firm*—Kenneth A. Haas

(57) ABSTRACT

An efficient antenna pattern shaping structure employs a parasitic element made of a conductive surface next to radio circuitry to shape the pattern of an associated antenna, preferably one that is a quarter wave antenna. The parasitic element is disposed on a first side of the radio circuitry to act as a reflector of electromagnetic energy. The parasitic element has at least two edges and wherein the at least two edges of the parasitic element are bent in a direction towards the radio circuitry in order to shape the antenna pattern more efficiently. The parasitic element is electrically slightly larger than a half wavelength of a frequency band of interest, preferably the low frequency of interest. A optional opposing parasitic element can be disposed on a second side of the radio circuitry opposite the first side. The opposing parasitic element is electrically slightly smaller than a half wavelength of the frequency band of interest, preferably half a wavelength of the high frequency of interest. A conductive surface, having bends at the ends and preferably grounded, on a side of a wiring board of the radio circuitry, can be used in addition to or instead of an independent parasitic element.

17 Claims, 1 Drawing Sheet

EFFICIENT ANTENNA PATTERN SHAPING STRUCTURE AND ASSOCIATED RADIO CIRCUITRY AND ANTENNA

BACKGROUND OF THE INVENTION

1. Technical Field

The present invention relates to antenna pattern shaping structures and, more particularly, relates to antenna pattern shaping structures for portable radios.

2. Description of the Related Art

Cellular radio telephones typically have telescopic or stubby antennas. Such telescopic antennas in the up position typically are half wave antennas. Such stubby antennas and telescopic antennas in the down position typically are quarter wave antennas.

Stubby antennas and telescopic antennas in the down position are known to be less efficient than telescopic antennas in the up position. This is because stubby antennas and telescopic antennas in the down position have antenna patterns typically produced by two quarter wave elements—first a helix in the stub and second the radio circuit board itself.

More efficient antennas increase radio performance because they are capable of pulling in weak radio signals. Efficient power transmission between antenna elements in a radio system can be increased by shaping the gain patterns of the antennas. Optimum gain pattern shapes of antennas look for signals where they can be best received. They also conserve portable battery capacity by focusing transmit energy in more optimum directions.

An effective way of improving the efficiency of stubby antennas and telescopic antennas in the down position on handheld portable radios is needed.

SUMMARY OF THE INVENTION

An efficient antenna pattern shaping structure employs a parasitic element of a conductive surface next to radio circuitry to shape an associated antenna, preferably one that is a quarter wave antenna. The parasitic element is disposed on a first side of the radio circuitry to act as a reflector of electromagnetic energy. The parasitic element has at least two edges and wherein the at least two edges of the parasitic element are bent in a direction towards the radio circuitry in order to shape the antenna pattern more efficiently. The parasitic element is electrically slightly larger than a half wavelength of a frequency band of interest, preferably the low frequency of interest. An optional opposing parasitic element can be disposed on a second side of the radio circuitry opposite the first side. The opposing parasitic element is electrically slightly smaller than a half wavelength of the frequency band of interest, preferably half a wavelength of the high frequency of interest. A conductive surface, having bends at the ends and preferably grounded, on a side of a wiring board of the radio circuitry, can be used in addition to or instead of an independent parasitic element.

The details of the preferred embodiments of the invention will be readily understood from the following detailed description when read in conjunction with the accompanying drawings wherein:

DETAILED DESCRIPTION OF THE PREFERRED EMBODIMENTS

Figure 1:
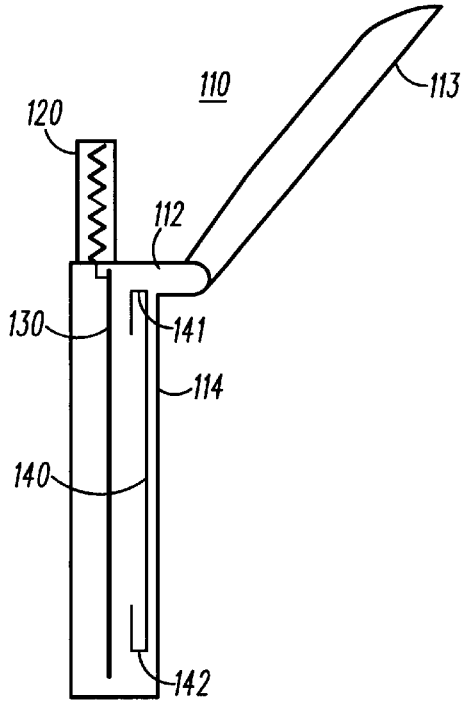
FIG. 1 illustrates a cross-sectional diagram of a radio telephone having a quarter wave antenna and the efficient antenna pattern shaping structure according to a first embodiment of the present invention.

FIG. 1 illustrates a cross-sectional diagram of a radio telephone 110 having a quarter wave antenna utilizing the efficient antenna pattern shaping structure according to a first embodiment of the present invention. The illustrated radio telephone 110 is of a conventional "flip" configuration having a hinge 112 and an ear piece 113, which covers a display and keyboard 114.

A helical antenna element 120 connects to radio circuitry 130 of the radio telephone. The radio circuitry 130 contains transmit and receive amplifiers which connect to the helical antenna element 120. The helical element 120 of the radio telephone 110 is preferably a quarter wave antenna element wherein both the radio circuitry 130 and the helical element 120 are elements of a resulting half wave antenna structure. The helical element 120 is one of two quarter wave elements of the half wave antenna and the radio circuitry itself 130 is a second quarter wave element. It is appreciated that in the physical world the electrical wavelength dimensions of the antenna elements are imperfect and the above half and quarter wavelength are approximate electrical dimensions.

A parasitic element 140 made of a conductive surface is disposed between the radio circuitry 130 and the display and keyboard 114 of the radio telephone 110. The parasitic element 140 is parasitically coupled to the half wave antenna made up of the helical element 120 and the radio circuitry 130. The conductive surface of the parasitic element 140 is preferably made of conductive cladding or foil, preferably copper. The parasitic elements could be supported in a number of ways, for example, they can be glued or adhered to the housing of a cellular radio telephone or glued or adhered to components of radio circuitry within the cellular radio telephone. The parasitic element 140 has upper and lower edges with bends 141 and 142 that are bent towards the radio circuitry in order to more efficiently shape the pattern of the antenna made up of the quarter wave helical coil 120 and the radio circuitry 130. The edges are bent at an angle sufficient to shape the antenna pattern efficiently. The antenna pattern shape increases its gain in the direction of the bends relative to its gain without the bends. The two edges of the parasitic element 140 are preferably bend at least approximately 180 degrees as illustrated. However, as will be discussed with respect to FIGS. 2–4, different bend configurations are possible.

The parasitic elements typically have four or more sides and currents on them from the radio operation. It is preferred that the two sides of the parasitic element perpendicular to the currents are bent. Bends in the sides, which are parallel to the currents, are not needed but will not detrimentally affect an ideal implementation. In practice, however, it might be seen that bends in the sides parallel the currents will help shape the antenna pattern a small amount. Typically for a handheld cellular radio telephone at the 900 MHz band, as illustrated, the upper and lower ends of a rectangular parasitic element would be bent inwardly. However, for the upper GHz range, in a handheld cellular radio telephone having a rectangular parasitic element of a similar size, it is expected that the sides of the parasitic element will typically be bent inwardly.

The parasitic element 140 is electrically slightly larger than a half wavelength of the frequency of operation of the radio telephone 110. Preferably, the parasitic element 140 is electrically slightly larger than a half wavelength of the low frequency of the band of operation of the radio telephone 110.

The helical coil antenna element 120 is the example in the illustrated cellular radio telephone of FIG. 1. Other types of antenna elements can benefit from the pattern shaping by the parasitic elements of the present invention. For example, a telescopic half wave antenna that is not completely matched will have some currents within the radio housing that can be shaped by the parasitic elements.

The benefits of the present invention are realized, not only in the antenna pattern shaping, but also in the distribution of currents and resulting fields in a near vicinity of the housing of the cellular radio telephone.

Figure 2:
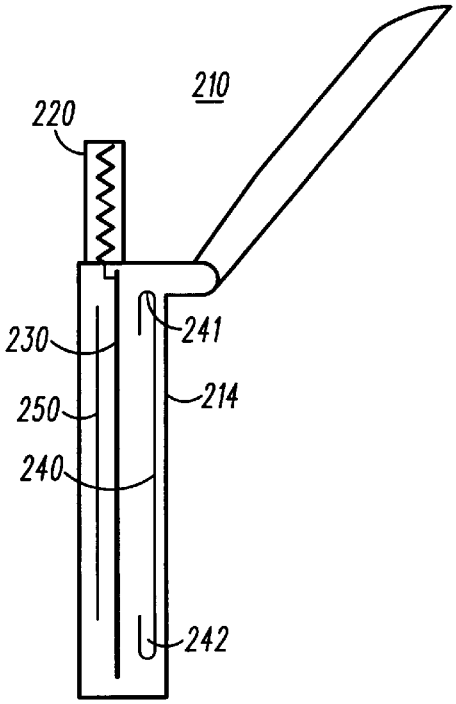
FIG. 2 illustrates a cross-sectional diagram of a radio telephone having a quarter wave antenna and the efficient antenna pattern shaping structure according to a second embodiment of the present invention.

FIG. 2 illustrates a cross-sectional diagram of a radio telephone 210 having a quarter wave antenna utilizing the efficient antenna pattern shaping structure according to a second embodiment of the present invention. A parasitic element 240 made of a conductive surface is disposed between radio circuitry 230 and a display and keyboard 214 of the radio telephone 210. The parasitic element 240 is parasitically coupled to the helical coil 220 and the radio circuitry 230.

In this second embodiment of FIG. 2, the parasitic element 240 has differently shaped bends 241 and 242 at its ends. The bends 241 and 242 are curved in contrast with the bends 141 and 141 of the first embodiment that are folded rigidly.

Also, in this second embodiment of FIG. 2, an opposing parasitic element 250 is provided on an opposite side of the radio circuitry 230. The opposing parasitic element 250 acts as a director positioned to focus electromagnetic energy towards its original direction of propagation. The opposing parasitic element 250 is preferably made of conductive cladding or foil, preferably copper. The opposing parasitic element 250 has an electrical length slightly shorter than about half a wavelength of the frequency of interest. The opposing parasitic element 250 preferably has an electrical length slightly smaller than half a wavelength at the high end of the band of operation of the radio telephone 210.

Figure 3:
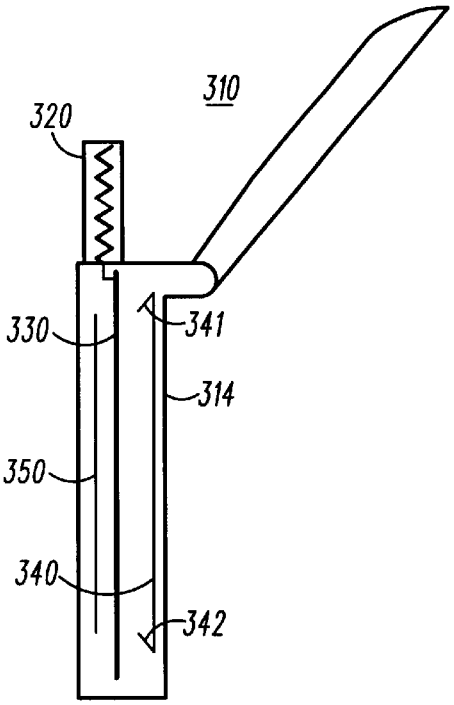
FIG. 3 illustrates a cross-sectional diagram of a radio telephone having a quarter wave antenna and the efficient antenna pattern shaping structure according to a third embodiment of the present invention.

FIG. 3 illustrates a cross-sectional diagram of a radio telephone 310 having a quarter wave antenna utilizing the efficient antenna pattern shaping structure according to a third embodiment of the present invention. A parasitic element 340 made of a conductive surface is disposed between radio circuitry 330 and a display and keyboard 314 of the radio telephone 310. The parasitic element 340 is parasitically coupled to the helical coil 320 and the radio circuitry 330.

In this third embodiment of FIG. 3, the parasitic element 340 has differently shaped bends 341 and 342 at its ends. The bends 341 and 342 are slanted in contrast with the bends of the first and second embodiments. These bends 341 and 342 are bent to more than approximately 90 degrees. The bends can also be a right angles to the parasitic element 340. It is preferred that the bends are no less than 90 degrees, otherwise the benefits of the bend become much reduced.

Additionally, in this third embodiment of FIG. 3, an opposing parasitic element 350 is provided on a second side of the radio circuitry 330.

Figure 4:
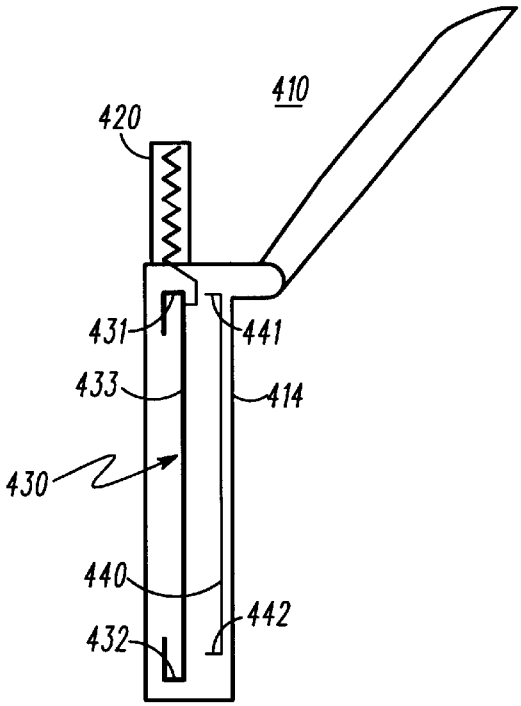
FIG. 4 illustrates a cross-sectional diagram of a radio telephone having a quarter wave antenna and the efficient antenna pattern shaping structure according to a fourth embodiment of the present invention.

FIG. 4 illustrates a cross-sectional diagram of a radio telephone 410 having a quarter wave antenna utilizing the efficient antenna pattern shaping structure according to a fourth embodiment of the present invention. A parasitic element 440 with bends 441 and 442 is disposed between radio circuitry 430 and a display and keyboard 414 of the radio telephone 410. The parasitic element 440 is parasitically coupled to a quarter wave antenna made up of a helical element 420 and the radio circuitry 430.

The fourth embodiment of FIG. 4 additionally contains a conductive surface 433 on a first side of the radio circuitry 430. The radio circuitry 430 is a wiring board such as a printed circuit board having radio frequency components on second side of the wiring board, opposite the first side of the wiring board. The conductive surface of the board is also bent to shape the antenna pattern. Bends 431 and 432 point in a direction sufficient to shape the antenna pattern in a desired direction. Preferably the bends 431 and 432 are directed toward the second surface containing the radio frequency components. The antenna pattern shape increases its gain in the direction of the bends relative to its gain without the bends.

Although both a parasitic element 440 and a conductive surface on the radio circuitry 430 is preferred for optimum performance, the antenna pattern can be efficiently shaped by the structure of the present invention utilizing either the conductive surface on the radio circuitry or the parasitic element by itself.

Although the present invention is applicable to other antennas, its performance had been found to be superior on an a quarter wave antenna because it causes currents on the radio circuitry. A common quarter wave antenna for a cellular telephone is either a stubby antenna or a telescoping antenna in the down position. Though a cellular telephone antenna is typically a quarter wave antenna in the down position, in the up position, a telescoping antenna is typically a half wave antenna.

Stubby antennas and telescopic antennas in the down position have antenna patterns produced by two quarter wave elements—first a helix in the stub and second the radio circuit board itself. The conductive surface of the present invention is disposed adjacent to the radio circuit board and thus more efficiently shapes the antenna pattern. For those antennas, which cause currents on the radio circuitry, the present invention has its greatest benefits.

Although the invention has been described and illustrated in the above description and drawings, it is understood that this description is by example only, and that numerous changes and modifications can be made by those skilled in the art without departing from the true spirit and scope of the invention. Although the examples in the drawings depict only example constructions and embodiments, alternate embodiments are available given the teachings of the present patent disclosure. For example the parasitic elements can be applied to handheld radios having of antennas other than a quarter or half wavelength and antennas without helical coils. The drawings are for illustrative purposes and, although relative sizes can be seen among the elements, they are not drawn to scale.

What is claimed is:

1. An efficient antenna pattern shaping structure for radio circuitry and its associated antenna, comprising:

a conductive surface disposed on a first side of the radio circuitry and extending substantially a length of the radio circuitry to act as a reflector of electromagnetic energy; and wherein the conductive surface has at least two edges and wherein the at least two edges of the conductive surface are bent in a direction in order to shape the antenna pattern more efficiently, wherein the direction of the bend is sufficient to shape the antenna pattern in a desired direction.

2. The efficient antenna pattern shaping structure according to claim 1, wherein the antenna pattern shape has increased gain in the direction of the bend.

3. The efficient antenna pattern shaping structure according to claim 1, wherein the at least two edges of the conductive surface are bent more than approximately 90 degrees.

4. The efficient antenna pattern shaping structure according to claim 1, wherein the at least two edges of the conductive surface are bent at least approximately 180 degrees.

5. The efficient antenna pattern shaping structure according to claim 1, wherein the conductive surface comprises a parasitic element.

6. The efficient antenna pattern shaping structure according to claim 1, wherein the radio circuitry comprises a wiring board;

wherein the conductive surface comprises a conductive layer on the surface of the wiring board; and wherein the conductive layer comprises the bent edges.

7. The efficient antenna pattern shaping structure according to claim 6, wherein the radio circuitry has a second side, opposite the first side, for components of the radio circuitry; and wherein the bent edges are bent in a direction towards the second side of the radio circuitry.

8. The efficient antenna pattern shaping structure according to claim 6, further comprising a parasitic element, electrically slightly larger than a half wavelength of the frequency of interest, spaced from and adjacent to the conductive surface on the first side of the radio circuitry to act as a reflector of electromagnetic energy, wherein the parasitic element has at least two edges and wherein the at least two edges of the parasitic element are bent in a direction towards the radio circuitry in order to shape the antenna pattern more efficiently.

9. An efficient antenna pattern shaping structure for radio circuitry and its associated antenna capable of operating in at least one frequency of interest, comprising:

a first antenna (120);

radio circuitry (130) acting along with the first antenna as a half-wave antenna;

a parasitic element (140) spatially separated from the radio circuitry, electrically slightly larger than a half wavelength of the frequency of interest, on a first side of the radio circuitry to act as a reflector of electromagnetic energy; and wherein the parasitic element has at least two edges and wherein the at least two edges of the parasitic element are bent in a direction towards the radio circuitry in order to shape the antenna pattern more efficiently.

10. The efficient antenna pattern shaping structure according to claim 9, wherein the at least one frequency of interest of the radio circuitry and its associated antenna operates on a band spanning from a high frequency of interest to a low frequency of interest; and wherein the parasitic element is electrically slightly larger than a half wavelength of the low frequency of interest.

11. The efficient antenna pattern shaping structure according to claim 9, wherein the at least two edges of the parasitic element that are bent are the at least two edges having lengths electrically slightly larger than a half of the wavelength of the frequency of interest.

12. The efficient antenna pattern shaping structure according to claim 9, wherein the at least two edges of the parasitic element are bent at an angle sufficient to shape the antenna pattern efficiently.

13. The efficient antenna pattern shaping structure according to claim 9, further comprising an opposing parasitic element, on a second side of the radio circuitry opposite the first side and electrically slightly smaller than a half wavelength of the frequency of interest.

14. The efficient antenna pattern shaping structure according to claim 13, wherein the at least one frequency of interest of the radio circuitry and its associated antenna operates on a band spanning from a high frequency of interest to a low frequency of interest;

wherein the parasitic element is electrically slightly larger than a half wavelength of the low frequency of interest; and wherein the opposing parasitic element is electrically slightly smaller than a half wavelength of the high frequency of interest.

15. The efficient antenna pattern shaping structure according to claim 9, wherein the at least two edges of the parasitic element are bent more than approximately 90 degrees.

16. The efficient antenna pattern shaping structure according to claim 9, wherein the at least two edges of the parasitic element are bent at least approximately 180 degrees.

17. An efficient antenna pattern shaping structure for radio circuit board of a radio, the radio circuit board capable of operating at least one frequency of interest, comprising:

a first antenna (320), wherein the first antenna acts along with the circuit board to form an antenna;

a reflector (340) on a first side of the circuit board shaped and positioned to act as a parasitic element slightly larger than about a half wavelength of the frequency of interest and reflect the electromagnetic energy back against its original direction of propagation, wherein the reflector is spatially separated from the circuit board; and a director (350) on a second side of the circuit board shaped and positioned to act as a parasitic element slightly shorter than about a half wavelength of the frequency of interest and focus electromagnetic energy in its original direction of propagation, wherein the director is spatially separated from the circuit board; and wherein the edges located on at least two ends of the reflector are in a direction towards the circuit board in order to shape the antenna pattern more efficiently.

* * * * *